United States Patent [19]

Schuster

[11] Patent Number: 4,728,026

[45] Date of Patent: Mar. 1, 1988

[54] HANDLE FOR SLEEVE-TYPE CARRIER

[75] Inventor: Richard L. Schuster, Monroe, La.

[73] Assignee: Manville Corporation, Denver, Colo.

[21] Appl. No.: 908,548

[22] Filed: Sep. 18, 1986

[51] Int. Cl.[4] ..... B65D 5/46

[52] U.S. Cl. ..... 229/52 B; 229/40

[58] Field of Search ..... 229/40, 52 B, 52 BC; 206/427, 434, 141

[56] References Cited

U.S. PATENT DOCUMENTS

| | | | |
|---|---|---|---|
| 3,578,238 | 5/1971 | Schillinger | 206/427 |
| 3,593,849 | 7/1971 | Helms | 206/434 |
| 3,750,874 | 8/1973 | Detzel et al. | 229/52 B |
| 4,405,078 | 9/1983 | Dutcher et al. | 229/52 B |
| 4,558,816 | 12/1985 | Wood | 229/52 B |
| 4,653,686 | 3/1987 | Wood et al. | 229/52 B |

FOREIGN PATENT DOCUMENTS

| | | | |
|---|---|---|---|
| 1602857 | 11/1981 | United Kingdom | 229/52 B |

*Primary Examiner*—Stephen Marcus
*Assistant Examiner*—Gary E. Elkins
*Attorney, Agent, or Firm*—John D. Lister; Cornelius P. Quinn; Timothy R. Schulte

[57] ABSTRACT

A sleeve-type beverage can carrier with a handle opening in the top panel extending across the entire width of the top panel. The opening further extends into the upper portion of the side panels, terminating in an arcuate edge. Upon lifting the carrier, the top panel between the edge of the handle opening being grasped and the nearest end panel is caused to bow upwardly by the lifting stresses, thereby distributing the stresses through the top panel and the upper portions of the side panels to prevent tearing.

8 Claims, 4 Drawing Figures

HANDLE FOR SLEEVE-TYPE CARRIER

FIELD OF THE INVENTION

This invention relates to a sleeve-type article carrier, and more particularly to a sleeve-type article carrier having an improved handle.

BACKGROUND OF THE INVENTION

Sleeve-type carriers are commonly used to package beverage cans. Such a carrier is typically formed from a paperboard blank which is opened into sleeve form by a packaging machine, after which the cans are introduced and the end panels folded and glued together. The resulting package completely encloses the cans and has a handle incorporated into the top panel to allow a user to more readily lift and carry the package.

Many different handle designs for sleeve-type packages have come into use over the years, probably the most common being the suitcase type of handle. This comprises two handle openings in the top panel extending lengthwise of the carrier and being spaced from each other so that the top panel portion between them forms a strap. The carrier is lifted by inserting the fingers in one of the openings and lifting up on the strap portion. One problem with this design is that the edges of the strap are often uncomfortable to the hand of the user, particularly if the package is carried for any length of time. Another is that the concentration of lifting stresses at the ends of the strap has necessitated the use of relatively thick paperboard to prevent tearing at these locations.

To overcome these problems it has been suggested to employ a transversely extending handle instead. Such a handle comprises a transverse opening in the top panel of the carrier through which the fingers are inserted. By then lifting up on the top panel the package can be lifted and carried more comfortably. Despite this result, such packages still are in need of improvement in the area of stress distribution. If no provision is made, such as in the handle arrangement disclosed in U.S. Pat. No. 2,718,301, issued to F. D. Palmer, the package is susceptible to tearing at the ends of the handle opening. Since the only way to prevent tearing in a design such as Palmer's is to use relative thick paperboard, the production costs increase as a result.

To combat the tendency to tear, the carrier disclosed in U.S. Pat. No. 4,558,816, issued to P. J. Wood, incorporates a slit that extends into the side panels of the carrier and also contains a series of fold lines connected to the slit. This arrangement is for the purpose of distributing the lifting stresses generated when the package is lifted by its handle. Even this design, however, permits more concentration of lifting stresses adjacent the ends of the transverse slit than desired, forcing relatively rigid design parameters to be followed and causing the top panel to be pulled up too abruptly when lifted.

It would be desirable to provide a carrier having a transverse handle design which would allow a reduction in the caliper of the paperboard without resulting in an excessively flexible handle structure.

BRIEF SUMMARY OF THE INVENTION

This invention provides an improved handle design which overcomes the problems mentioned above. The top panel of the carrier contains a handle opening comprising two elongated spaced edges extending across the entire width of the top panel. The opening extends into the upper portions of the side panels of the carrier across the folds connecting the side panels to the top panel. When the carrier is lifted the top panel between the user's hand and the nearest end panel will bow upwardly in a gentle uniform manner, distributing the lifting stresses relatively uniformly throughout that portion of the top panel and the upper portions of the side panels.

These design features can readily be implemented in the standard type of production blank from which sleeve-type carriers are produced. Requiring only minor changes to the blank forming die to provide for new slit and score lines.

Other features and aspects of the invention will be made clear, as well as the various benefits of the invention, in the more detailed description of the invention which follows.

DESCRIPTION OF THE INVENTION

Figure 1:
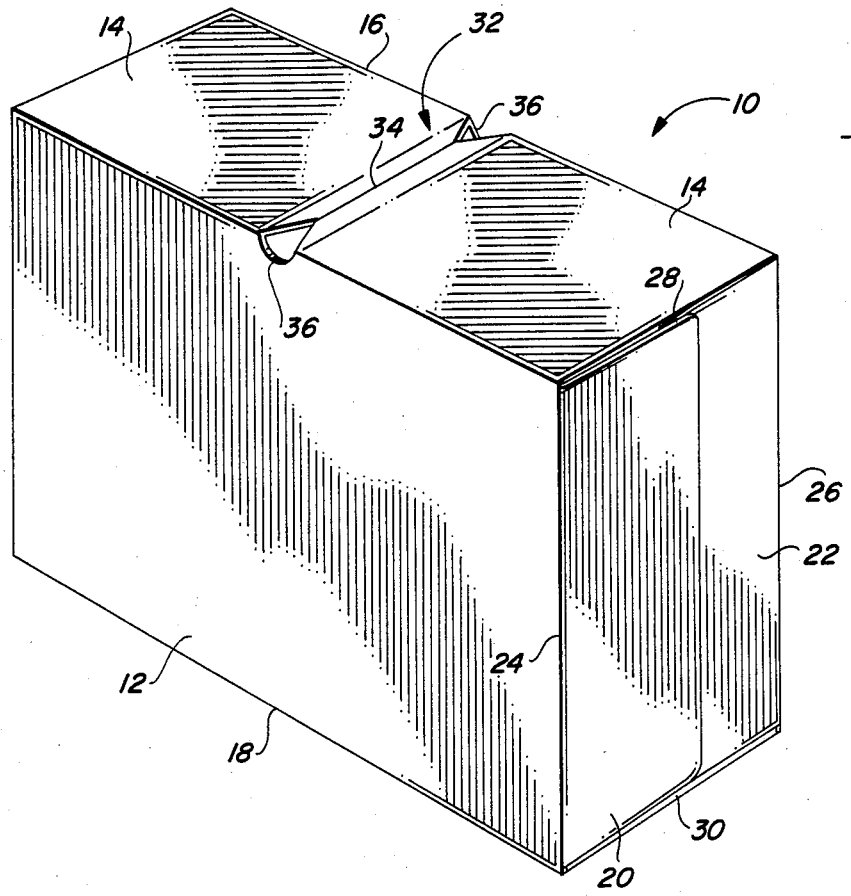
FIG. 1 is a pictorial representation of a preferred embodiment of the sleeve-type carrier of the present invention, as it would appear prior to being lifted by its handle.

Referring to FIG. 1, the carrier 10 comprises side panels 12 connected to the top panel 14 by folds 16 and to the bottom panel, not visible in this view, by folds 18. The end panel shown is comprised of flaps 20 and 22 connected to the side panels by folds 24 and 26, respectively. The end flaps 20 and 22 are adhered to dust flaps 28 and 30 by glue. The dust flaps, only a small portion of which are visible in this view, are foldably connected to the top and bottom panels. A similar end panel arrangement is provided at the other end of the carrier. In addition to the above structure, a handle opening 32 is incorporated in the top panel 14. The opening, which is partially cover by flaps 34, can be seen to extend into the upper portion of the side panels 12 at 36.

Figure 2:
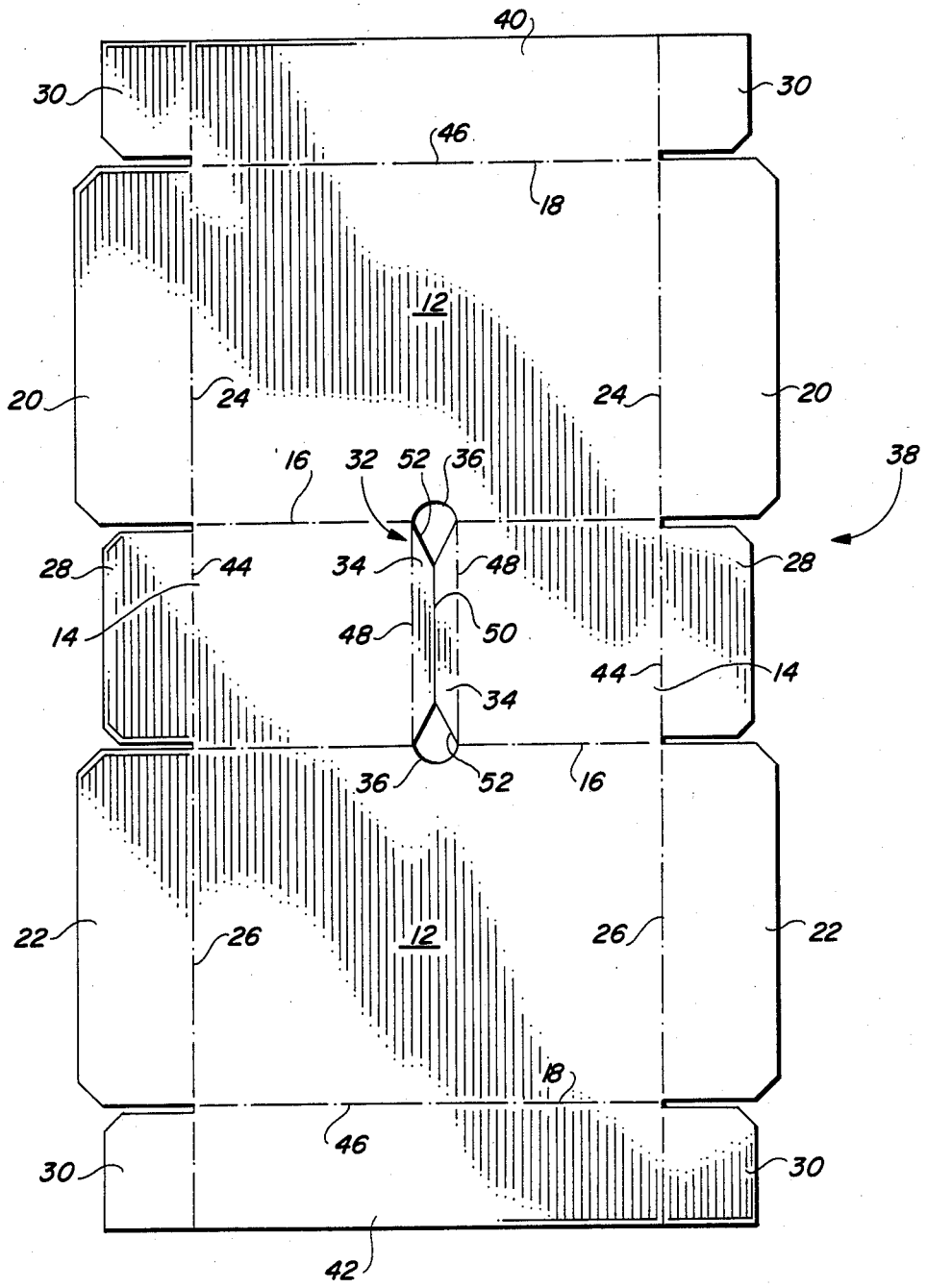
FIG. 2 is a plan view of a production blank for forming the carrier of FIG. 1.

A production blank used to form the carrier of FIG. 1 is indicated generally by reference numeral 38 in FIG. 2. The blank 38 is comprised of a central section 14 connected to intermediate sections 12 by score lines 16, the central section corresponding to top panel 14, the intermediate sections corresponding to side panels 12, and the score lines corresponding to the folds 16. Connected to intermediate sections 12 by score lines 18 are end sections 40 and 42 which are dimensioned so that portions of them are overlapped when the blank is folded along score lines 16 and 18. The overlapped portions are glued together to form the bottom panel of the carrier 10.

Flaps 20 and 22 are connected to the intermediate sections by score lines 24 and 26, respectively, enabling them to be folded toward each other to form the end panels of the carrier. Dust flaps 28, connected to the central section 14 by score lines 44, are adapted to be folded prior to the end flaps 20 and 22 being folded toward each other in order to act as a support against which the flaps 20 and 22 are glued. Similarly, dust flaps 30, connected to end sections 40 and 42 by score lines 46, are adapted to be folded prior to the folding of the end flaps so that they too can act as a support against which the flaps 20 and 22 are glued. The blank design described thus far is well known in the art and can be formed into a carrier capable of supporting the weight of the number of full beverage cans being packaged.

Still referring to FIG. 2, the handle opening can be seen to extend beyond the score lines 16 into the intermediate sections at 36. The extensions 36 are arcuate in shape and preferably are in the form of a semi-circle whose diameter is aligned with the adjacent score line 16. When the blank is formed into a carrier the portion of the handle opening located in the upper region of the side panels is the semi-circular cutout, as shown in FIG. 1.

As shown in FIG. 2, the handle flaps 34 are foldable connected to the top panel along the elongated edges 48 of the opening 32. The opposite or adjacent edges of the flaps meet in the center of the handle opening along slit 50. Preferably the edges are connected together in the blank by widely spaced sections of uncut paperboard, not shown, which can readily be broken or torn by the user when his fingers are inserted into the handle opening of a carrier formed from the blank.

Preferably the fold lines of the flaps 34 extend substantially out to the score lines 16, but the slit 50 terminates short of the score lines 16. As a result the edges 52 connecting the free edges of the flaps 34 to their fold lines 48 are angled fairly sharply away from the score lines 16. This creates a substantial area in the handle opening adjacent the score lines 16 which is uncovered by the handle opening flaps 34. Although this arrangement is not essential to the stress distribution phenomenon discussed hereinafter, it is beneficial in several respects. It resolves a potential production complication by eliminating stock at a point which could interfere with the stripping of the blank from the press and it provides a visual guide to the user as to where the handle opening is and how it should be used. In addition, the shorter free edge of the flap provides less resistance to movement of the flap past underlying cans where the cans are packed tightly up against the top panel.

Figure 3:
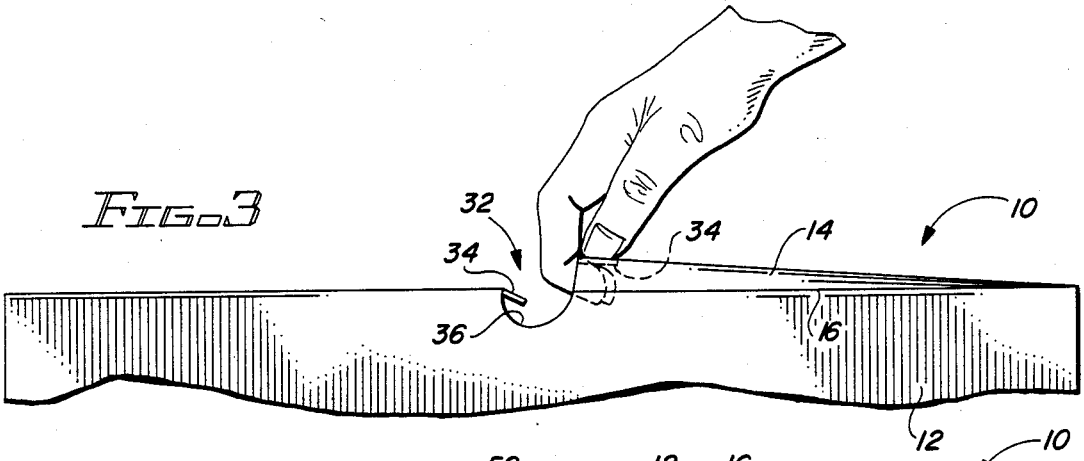
FIG. 3 is a partial side view of the carrier of FIG. 1, illustrating the upward bowing of the top panel during lifting.

Referring to FIG. 3, this view shows the distortion of the top panel 14 that occurs when a user lifts the carrier 10. When the fingers press down on one of the flaps 34 the other flap 34 is contacted by the back of the fingers and is thereby folded downwardly a distance sufficient to allow the fingers to enter the handle opening. The first flap is engaged by the pads of the fingers and is folded down about its fold line. Continued pressure against the first flap folds it up against the underside of the top panel, as shown in dotted lines. As the user begins lifting the carrier, the lifting action causes the engaged top panel portion to bow upwardly, while the unengaged top panel portion remains flat. When this happens, the stresses created at the ends of the handle opening cause the arcuate edge to distort, the view in FIG. 3 showing a typical distortion of a semi-circular handle opening edge. Because of the arcuate shape the liftng stresses do not tear the ends of the handle opening.

Figure 4:
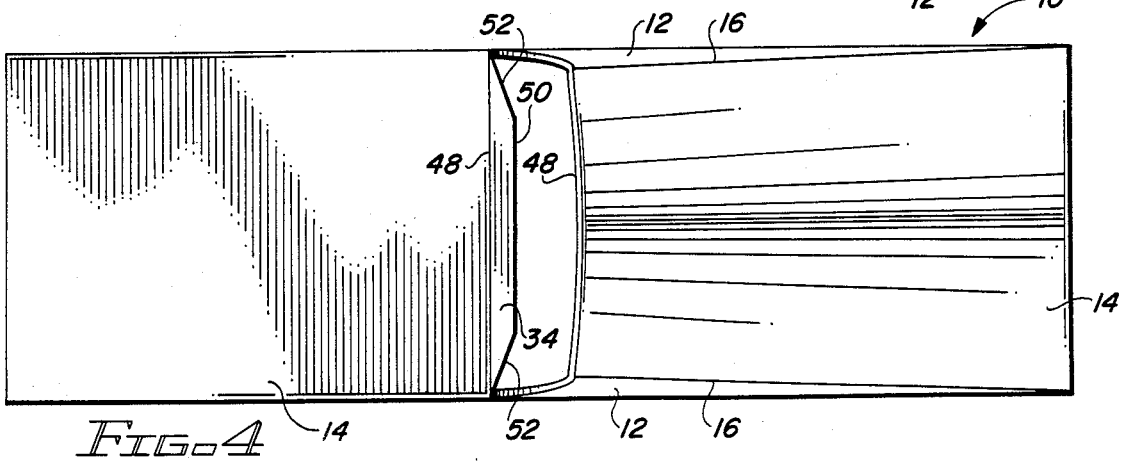
FIG. 4 is a plan view of the carrier of FIG. 3, illustrating the distortions in the folds connecting the top panel and the side panels during lifting, the hand of the person lifting the carrier being omitted for purpose of clarity.

As shown in FIG. 4, the flap 34 attached to the left side of the handle opening has been pushed or folded downwardly enough to allow entry of the fingers into the handle opening. The elongated edge at the right side of the opening is shown in bowed condition and the folds 16 are shown as having been distorted inwardly in the region of the handle opening, pulling the upper portions of the adjacent side panels 12 inwardly also. The smooth uniform upward bowing of the top panel indicates a uniform distribution of the lifting stresses, avoiding a concentration of stresses in any one area and thus avoiding tearing of the paperboard.

It should now be apparent that the carrier of the present invention not only is more convenient to lift due to the arrangement of the single transverse handle opening and the manner in which the top panel distorts to permit easy finger access into the opening, but is also more economical to produce. Whereas thicker stock is required to provide adequate strength in prior art sleeve-type carriers, thinner stock can be used to produce the carrier of this invention.

It should be obvious that although a preferred embodiment of the invention has been described, changes to certain specific features of the preferred embodiment can be made without departing from the spirit and scope of the invention.

What is claimed is:

1. A sleeve-type article carrier, comprising:

a top panel;

a bottom panel;

side panels foldably connected to the top and bottom panels;

end panels between the top, bottom and side panels;

the top panel containing a handle opening comprising two elongated spaced edges extending across the entire width of the top panel between the foldable connections between the side panels and the top panel;

each elongated edge of the handle opening being foldably connected to a flap, the edges of the flaps opposite their foldable connections to the elongated handle opening edges meeting intermediate the elongated edges of the handle opening; and the length of the meeting edges of the flaps being substantially less than the width of the top panel, whereby substantial portions of the handle opening in the top panel adjacent the foldable connection between the side panels and the top panel are exposed; and the handle opening extending into the side panels adjacent the foldable connections between the side panels and the top panel;

whereby either flap can be pressed down and folded about its foldable connection by the fingers of a person lifting the carrier, and upon the carrier being lifted the top panel adjacent the folded-down flap will bow upwardly.

2. An article carrier according to claim 1, wherein the meeting edges of the flaps are weakly connected to each other so as to be readily separated when the fingers of a user press down against one of the flaps.

3. An article carrier according to claim 1, wherein the length of the meeting edges of the flaps is substantially less than the length of the foldable connection between the flaps and the elongated spaced edges of the handle opening.

4. An article carrier according to claim 1, wherein the portion of the handle opening extending into the side panels is of arcuate shape.

5. An article carrier according to claim 4, wherein the portion of the handle opening in the side panels is semicircular in shape and wherein the diameter of the semicircle is equal to the spacing between the elongated edges of the handle opening at the foldable connections between the side panels and the top panel.

6. A production blank adapted to be formed into a sleeve-type carticle carrier, comprising:

a sheet of generally rectangular shape;

the sheet having a central section intended to become the top panel of the carrier, and sections adapted to be connected together to form the bottom panel of the carrier, intermediate sections connected to the central and end sections by score lines and intended to become the side panels of the carrier, and flap sections connected to the intermediate sections by score lines and intended to become the end panels of the carrier;

the central section containing a handle opening comprising two elongated spaced edges extending across the entire width of the central section between the score lines connecting the intermediate sections to the central section;

each elongated edge of the handle opening being foldably connected to a flap covering a portion of the handle opening between the score lines connecting the intermediate sections to the central section, the length of the edges of the handle opening flaps opposite their foldable connections to the elongated handle opening edges being substantially less than the width of the central section, whereby substantial portions of the handle opening in the central section adjacent the score lines connecting the intermediate sections to the central section are exposed; and the handle opening extending into the intermediate sections adjacent the score lines connecting the intermediate sections to the central section, the portions of the handle opening in the intermediate sections being uncovered by any flap;

whereby either handle opening flap of a carrier formed from the blank can be pressed down by the fingers of a person lifting the carrier and folded down about its foldable connection, and upon the carrier being lifted the top panel adjacent the folded-down flap will bow upwardly.

7. A production blank according to claim 6, wherein the length of the edges of the handle opening flaps opposite their foldable connections to the elongated handle opening edges is substantially less than the length of the foldable connection between the handle opening flaps and the elongated spaced edges of the handle opening.

8. A production blank adapted to be formed into a sleeve-type article carrier, comprising:

a sheet of generally rectangular shape;

the sheet having a central section intended to become the top panel of the carrier, end sections adapted to be connected together to form the bottom panel of the carrier, intermediate sections connected to the central and end sections by score lines and intended to become the side panels of the carrier, and flap sections connected to the intermediate sections by score lines and intended to become the end panels of the carrier;

the central section containing a handle opening comprising two elongated spaced edges extending across the entire width of the central section between the score lines connecting the intermediate sections to the central section;

each elongated edge of the handle opening being foldably connected to a flap covering a portion of the handle opening between the score lines connecting the intermediate sections to the central section.

the handle opening extending into the intermediate sections adjacent the score lines connecting the intermediate sections to the central section, the portions of the handle opening in the intermediate sections being uncovered by any flap;

the portions of the handle opening in the intermediate sections being of arcuate shape and the elongated edges of the handle opening being parallel to each other and being spaced apart a distance substantially equal to the distance between the ends of the arcuate end portion of the handle opening;

whereby either handle opening flap of a carrier formed from the blank can be pressed down by the fingers of a person lifting the carrier and folded down about its foldable connection, and upon the carrier being lifted the top panel adjacent the folded-down flap will bow upwardly.

* * * * *

UNITED STATES PATENT AND TRADEMARK OFFICE

CERTIFICATE OF CORRECTION

PATENT NO. : 4,728,026

DATED : March 1, 1988

INVENTOR(S) : Richard L. Schuster

It is certified that error appears in the above—identified patent and that said Letters Patent is hereby corrected as shown below:

Column 5, Line 8:
sleeve-type article carrier, comprising:

Column 5, Line 11:
the top panel of the carrier, end sections adapted to

Signed and Sealed this

Nineteenth Day of July, 1988

*Attest:*

DONALD J. QUIGG

*Attesting Officer*

*Commissioner of Patents and Trademarks*